United States Patent [19]

Baldelli

[11] Patent Number: 4,653,568

[45] Date of Patent: Mar. 31, 1987

[54] FOUNDRY PROCESS AND APPARATUS, INCLUDING MIXING INVESTMENT COMPOSITION UNDER VACUUM

[75] Inventor: Joseph Baldelli, Nashua, N.H.

[73] Assignee: Fabraze, Inc., Nashua, N.H.

[21] Appl. No.: 476,384

[22] Filed: Mar. 17, 1983

[51] Int. Cl.[4] ..... B22C 9/04

[52] U.S. Cl. ..... 164/7.1; 164/15; 164/35; 164/154; 164/160.1; 164/456; 366/139; 366/141

[58] Field of Search ..... 164/15, 7.1, 160.1, 164/516–519, 456, 35, 154; 366/139, 141

[56] References Cited

U.S. PATENT DOCUMENTS

| | | | |
|---|---|---|---|
| 2,453,914 | 11/1948 | Hollenback | 366/139 X |
| 2,482,257 | 9/1949 | Frei, Jr. | 164/15 X |
| 2,877,524 | 3/1959 | Bishop | 366/141 X |
| 2,884,963 | 5/1959 | Erndt | 141/284 X |
| 3,249,969 | 5/1966 | Steinbock, Jr. | 164/160.1 |
| 3,314,117 | 4/1967 | Fischman et al. | 164/7.1 |
| 3,366,369 | 1/1968 | Ravasi | 366/139 X |
| 3,446,266 | 5/1969 | Watts et al. | 164/160.1 |
| 3,640,510 | 2/1972 | Lea | 366/139 |
| 3,651,855 | 3/1972 | Daussan | 164/7.1 |
| 3,708,154 | 1/1973 | Middleton | 164/5 X |
| 3,812,898 | 5/1974 | Horton | 164/516 |

FOREIGN PATENT DOCUMENTS

| | | | |
|---|---|---|---|
| 985010 | 3/1976 | Canada | 164/7.1 |
| 2735640 | 2/1978 | Fed. Rep. of Germany | 164/7.1 |
| 45-35517 | 11/1970 | Japan | 366/139 |
| 564967 | 8/1975 | Switzerland | 366/139 |

*Primary Examiner*—Nicholas P. Godici
*Assistant Examiner*—J. Reed Batten, Jr.
*Attorney, Agent, or Firm*—Wolf, Greenfield & Sacks

[57] ABSTRACT

A foundry process and associated apparatus for providing mixing of water, an additive, and a casting (investment) for the automated powder, which once mixed, are to be delivered to molds to form casting molds such as in the fabrication of microwave components (castings). The apparatus comprises a source of water, a source of additive and a source of the casting powder. There is provided a mixing bowl and automatic control means for coupling the water and additive to the mixing bowl and thereafter delivering the investment powder to the mixing bowl to provide for the thorough mixing of all of these components. The mixing bowl has associated therewith a manually operated valve which permits delivery of the mixed material into flasks disposed in a mixing chamber disposed under the mixing bowl. In accordance with the control provided in accordance with the invention, the mixing occurs initially without vacuum over a first predetermined period of time which may be on the order of 1–3 minutes. Thereafter, a vacuum is drawn on both the mixing bowl and the chamber in which the flasks are disposed for the purpose of eliminating any air voids in the mixture. During the application of the vacuum, the mixed material is selectively dispensed by manual control outside of the chamber so that each of the molds is properly filled. Thereafter the vacuum is vented and the flasks are removed. This is then followed by a rinsing sequence so that the bowl can be cleaned and readied for subsequent mixing.

35 Claims, 7 Drawing Figures

FOUNDRY PROCESS AND APPARATUS, INCLUDING MIXING INVESTMENT COMPOSITION UNDER VACUUM

BACKGROUND OF THE INVENTION

The present invention relates in general to a foundry process and associated apparatus, and relates, more particularly, to a solid mold investment casting-lost wax process. In general, such a process involves a mixing of an investment powder with water and usually one other material commonly referred to as LUDOX (investment casting strengthener) which is used as a strengthener. These materials are mixed and then dispensed into a mold. As described hereinafter, the process of this invention is used in particular for the construction of microwave waveguide components castings.

At the present time the mixing operation employed in making the casting material is carried out manually. As such the process is time consuming and the time involved in constructing each component is relatively long. It has also been found that one of the key problems of the present process is that the final product tends to have surface irregularities (dimples or depressions) which are present because of an inadequate technique for removing all air bubbles or air pockets that appear in the investment casting material.

Accordingly, it is an object of the present invention to provide an improved foundry process and associated apparatus, particularly an improved solid mold investment casting-lost wax process and associated apparatus.

Still another object of the present invention is to provide an improved foundry process and apparatus as in accordance with the preceding object and which is substantially automated so that components can be manufactured more quickly and more reliably.

A further object of the present invention is to provide an improved foundry process and associated apparatus which substantially entirely eliminates surface irregularities in the final fabricated product. This is carried out in accordance with the present invention with the use of a vacuum in a predetermined manner so as to eliminate any air pockets in the investment casting mixture. In this way the casting material fills the entire mold cavity without producing surface irregularities in the final fabricated product.

Still a further object of the present invention is to provide an improved foundry process and apparatus in which the process is carried out in a relatively clean atmosphere. This has the effect of making the entire process environmentally safe.

Still another object of the present invention is to provide an improved foundry process and apparatus which is automated thus reducing the chance of human error. As a result the products (mold) that are manufactured by this process are of more uniform consistency.

SUMMARY OF THE INVENTION

To accomplish the foregoing and other objects of this invention there is provided a foundry process and associated apparatus that provides for the automatic mixing of the basic components that make up the investment casting material. The apparatus of this invention comprises a source of investment powder, a source of water, and a source of LUDOX (investment casting strengthener) or the like. The system of this invention also comprises computer controls for controlling the introduction of the different materials that make up the investment material and for controlling the vacuum. Vacuum is used in association with both the chamber in which the mixing occurs and the mixing bowl itself. The application of vacuum assures that no dimples appear on the final product. As mentioned previously these dimples occur because of air pockets or air voids not filled by the mixed investment casting material. In the sequence of operation in accordance with the present invention a predetermined amount of investment powder, water and LUDOX (investment casting strengthener) are weighed. The LUDOX (investment casting strengthener) and water are sent to the mixing bowl and then the powder is blown into the mixing bowl and concurrently therewith, the mixing operation commences. Mixing occurs for a predetermined period of time without any vacuum until a timer which is part of the computer controls times out. This mixing period may occur from anywhere from one minute to three minutes. Thereafter, vacuum is drawn for on the order of a minute and a half so as to make sure that there are no air voids in the mixture. The vacuum is also drawn on the chamber to make sure that no air interferes with the mixed material which is poured in the chamber into metal stainless steel flasks in the form of molds. These flasks are preferably on a lazy Susan arrangement and the dispensing into each of these flasks is under manual control at a place external to the chamber. Further details of the apparatus and process are discussed hereinafter in connection with the detailed description.

BRIEF DESCRIPTION OF THE DRAWINGS

Numerous other objects, features and advantages of the invention will become apparent upon a reading of the following detailed description taken in conjunction with the accompanying drawings, in which.

DETAILED DESCRIPTION OF THE PREFERRED EMBODIMENTS

Figure 1:
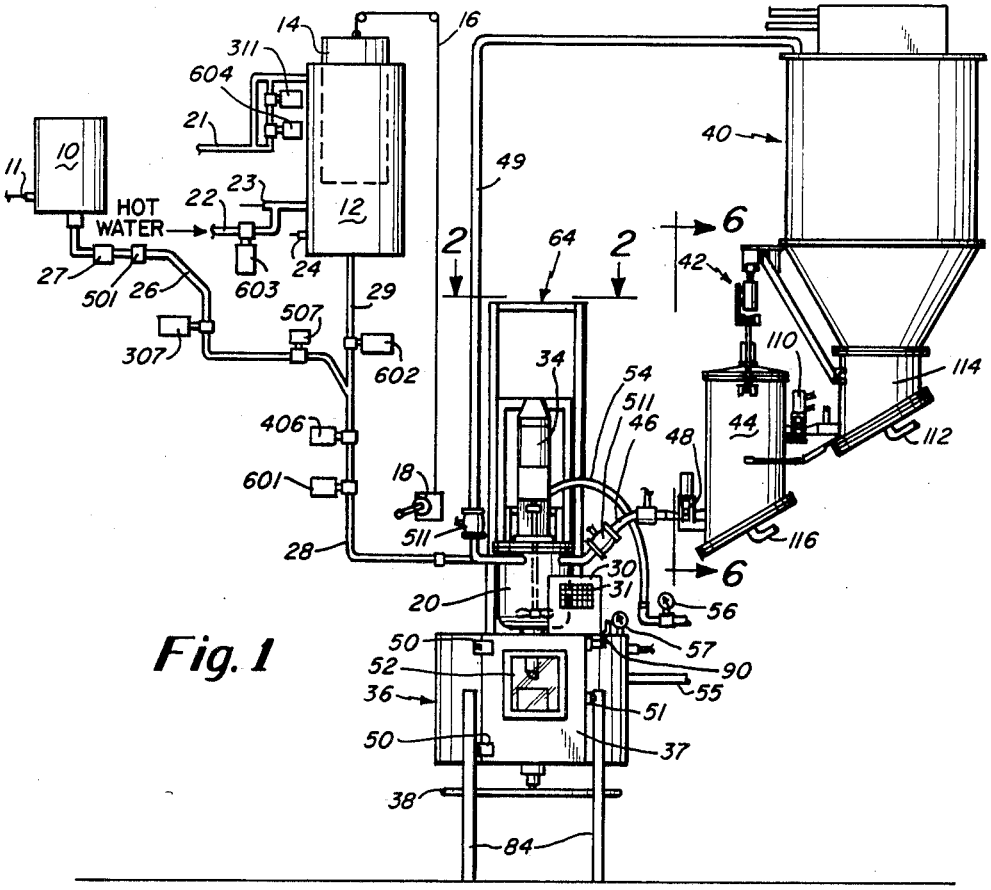
FIG. 1 is a front elevation view showing the entire foundry or casting process of this invention.

With reference now to the drawings and in particular FIG. 1, there is shown the basic overall system in which, under computer control, LUDOX (investment casting strengthener), or the like, and water are coupled to a mixing bowl and then the investment power is blown into the mixing bowl and concurrently therewith, the mixing operation commences. FIG. 1 shows a LUDOX (investment casting strengthener) chamber 10 having associated therewith a low level sensor device 11 to determine when the liquid LUDOX (investment casting strengthener) requires refilling. There is also provided a water source in the form of a cylindrical water tank 12 having disposed therein a mass or weight 14 which couples by means of a pulley line or cable 16 to a hand winch 18. The hand winch 18 is for adjusting the position of the weight 14 in the tank 12 so as to provide different displacements of water in the tank and thus control the volume of water that is metered to a mixing bowl 20.

The water tank 12 has an overflow line 21 having associated therewith solenoid valve 604 and temperature sensor 311. FIG. 1 also shows the hot water input at line 22. This line 22 has associated therewith a solenoid valve 603 for controlling flow through the line 22 to the water tank 12. There is also provided a thermocouple 23 associated with line 22 and a second thermocouple 24 associated with the tank itself. These thermocouples detect temperature and in turn can control certain of the solenoid valves such as the valve 603.

From the LUDOX (investment casting strengthener) chamber 10 there is a fluid line 26 which couples to a line 28 which in turn connects into the mixing bowl 20. Similarly, there is a water coupling line 29 that couples from the water tank 12 to the line 28. The line 26 includes a manual valve 27, solenoid valves 501 and 507 and temperature sensor 307. The line 29 includes a manual/electrical valve 602. The line 28 includes a temperature sensor 406 and a manual/electrical valve 601. The various temperature sensors such as sensors 307 and 406 are to detect undesired variations in temperature of the liquids and can terminate operation. The solenoid valves are under electrical control from the control electronics of this invention which is not shown in detail herein but which is understood to be basically of conventional computer control design. FIG. 1 does illustrate a control box 30 with its associated control panel 31. The sequence of operation in accordance with this invention is discussed in further detail hereinafter.

With respect to the introduction of the water and LUDOX (investment casting strengthener) the process operates so that the LUDOX (investment casting strengthener) from the chamber 10 is released under control of the solenoid valves 501 and 507 into the line 28. However, the control valve 601 is closed. Thereafter, the water is introduced to the line 29 and the water is used to flush both the water and LUDOX (investment casting strengthener) into the mixing bowl 20. This sequence of operation is such that the valve 602 operates first followed by the valve 601 so as to provide the proper flushing action particularly of the LUDOX (investment casting strengthener) and to cause some mixing of the LUDOX (investment casting strengthener) with the water even prior to introduction into the mixing bowl 20. Incidentally, the LUDOX (investment casting strengthener) is a strengthener basically and is added along with the water to provide a stronger casting.

FIG. 1 also shows, above the mixing bowl 20, a mixer 34, and below the mixing bowl 20, a chamber 36 wherein the previously mixed investment material is then poured into flasks to be illustrated hereinafter in FIG. 3. The chamber 36 has a front door 37 to provide access thereto and has a control wheel 38 which operates a lazy Susan within the chamber 36. Typically, there are provided a number of flasks disposed on the lazy Susan as illustrated in FIG. 3.

FIG. 1 also illustrates a powder hopper 40, weighing scale apparatus 42, and a weighing chamber 44. Further details of this apparatus are discussed in connection with FIG. 6 hereinafter. It is noted that there is a powder input line 46 which contains a control valve 511 and a pinch valve 48. Line 46 connects into the mixing bowl 20. There is also provided associated with the mixing bowl 20 a powder out or powder return line 49 also illustrated in FIG. 2. The line 49 contains the control valve 511. It is noted in FIG. 1 that this powder return line couples back to the top of the powder hopper 40.

Figure 2:
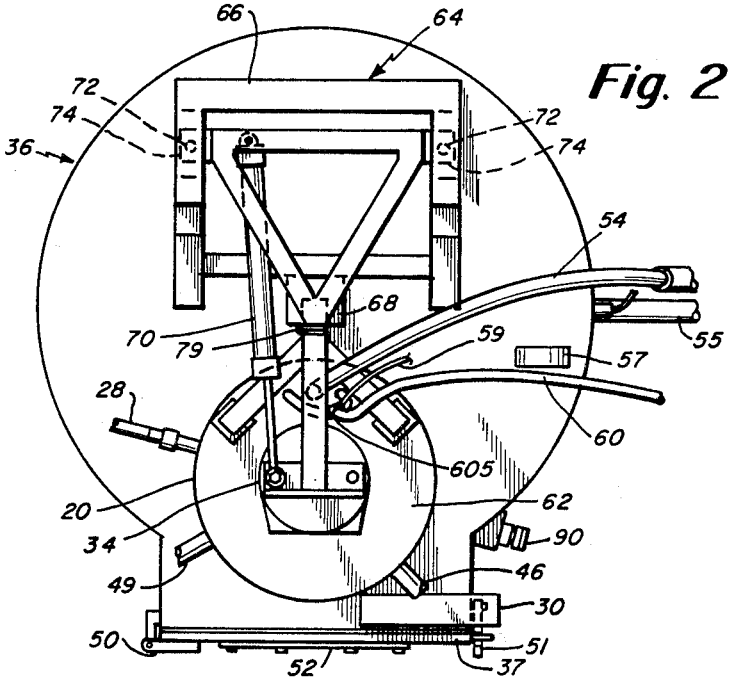
FIG. 2 is a cross-sectional plan view as taken along line 2—2 of FIG. 1.
Figure 4:
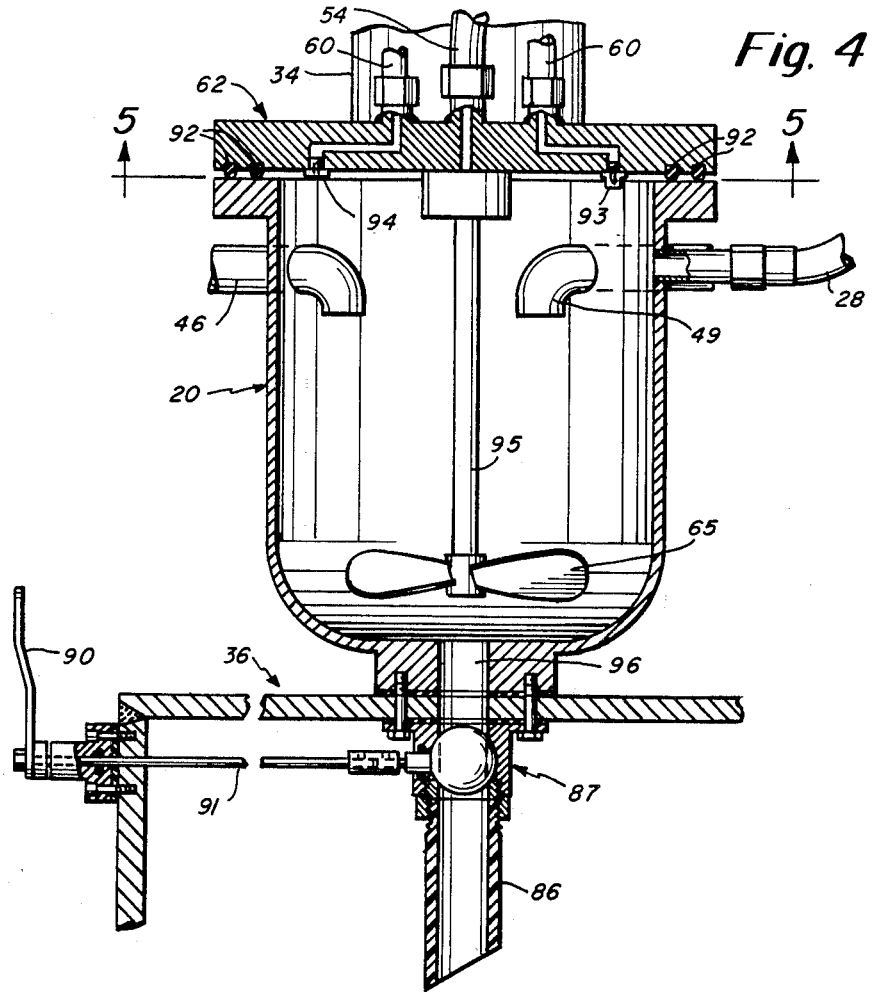
FIG. 4 is a cross-sectional view taken along line 4—4 of FIG. 3 through the mixing bowl showing further details thereof.
Figure 5:
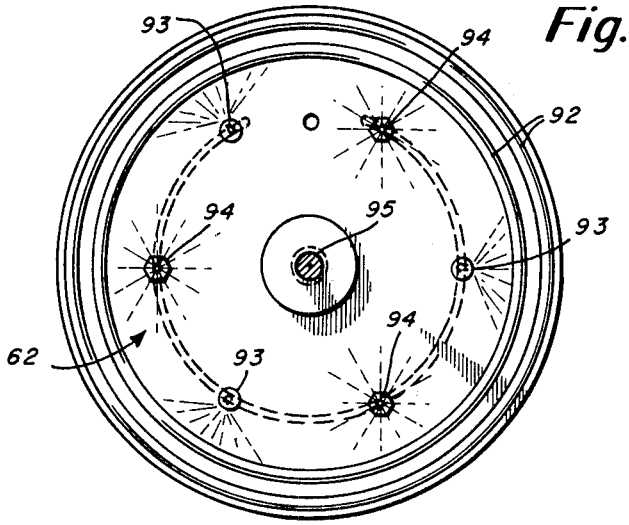
FIG. 5 is a cross-sectional plan view taken along line 5—5 of FIG. 4.

With reference to FIGS. 1 and 2, it is noted that the door 37 has hinges 50 and a door latch 51. There is also provided a viewing port 52 so that one can observe the flasks within the chamber. This viewing port 52 is gasketed as illustrated by gasket 53 in FIG. 3. There are also provided vacuum lines that connect to the chamber and the mixing bowl. These include a vacuum line 54 that couples to the mixing bowl 20 and a vacuum line 55 which couples directly to the chamber 36. The line 54 has in it a vacuum gauge 56. Similarly, there is a vacuum gauge 57 associated directly with the chamber 36. FIG. 2 also shows a hot water rinse valve 605 controlled by an air line 59 from an air valve (not shown). Further details of the rinse lines and the vacuum lines are illustrated in FIGS. 4 and 5. It is noted that FIG. 2 also shows a hot water rinse line 60.

Figure 3:
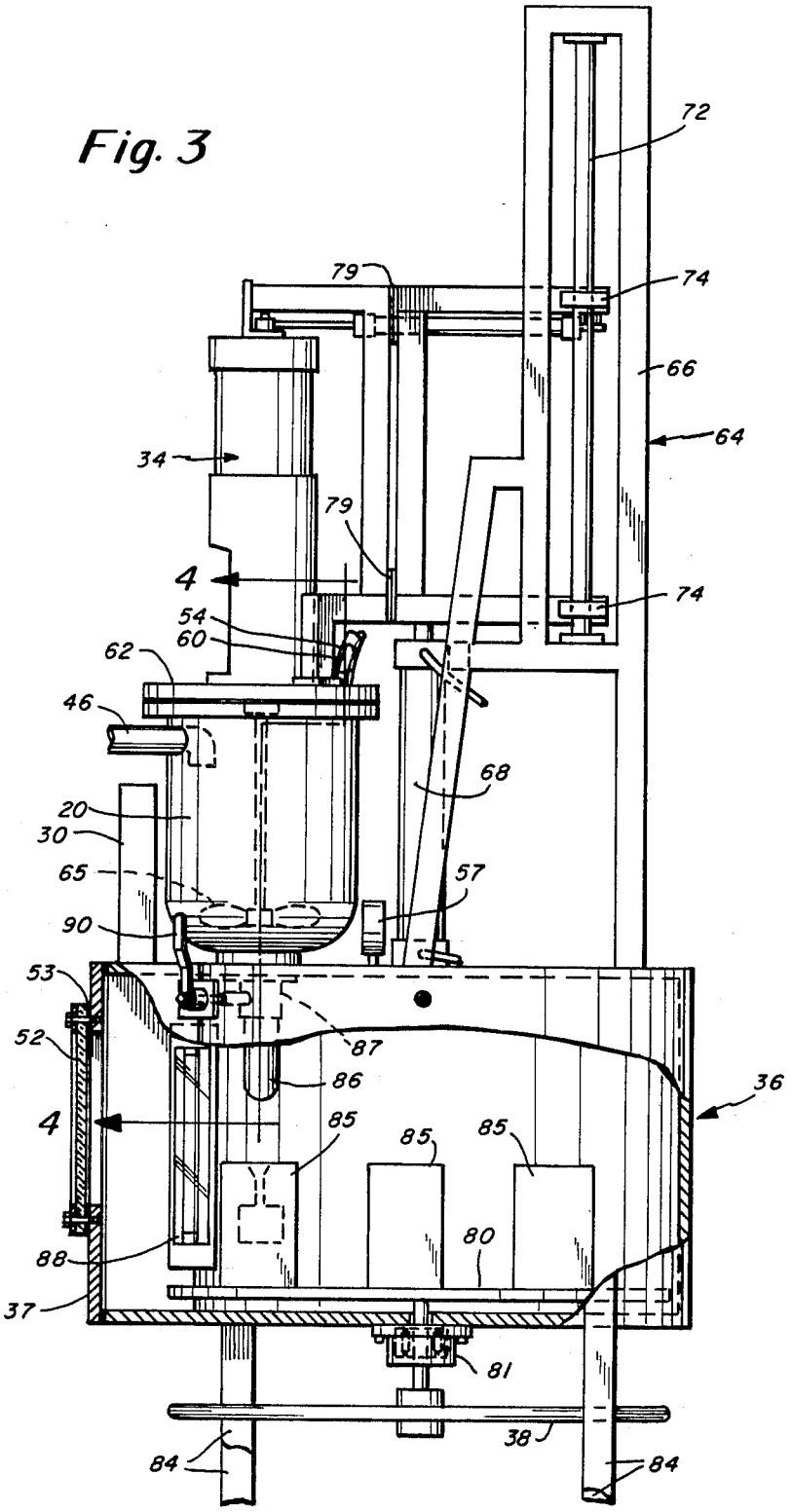
FIG. 3 is a side elevation view of a portion of the apparatus of FIG. 1 showing in particular the mixing bowl and associated chamber.

With reference to FIGS. 2 and 3, there is shown the mixing bowl 20 which includes a cover 62, the mixer 34 and support framework 64 associated with the mixer 34. The mixer 34 may be of conventional design such as a type Lightening mixer. In the position illustrated in FIG. 3 the mixer is shown as having its mixing propeller 65 in its mixing position fully down into the bowl 20. FIG. 3 also illustrates the powder input line 46, the vacuum line 54 and the rinse lines 60. The vacuum gauge 57 is shown disposed at the top of the chamber 36 and the chamber 36 is shown with its front door 37 and associated viewing port 52.

The support framework 64 for the mixer 34 includes support member 66. The mixer 34 is adapted to be moved along with the cover 62 upwardly in FIG. 3 so as to remove the mixing propeller 65 from the mixing bowl 20. In this connection there is provided an up/-down cylinder 68. Also, the mixer 34 is preferably capable of being rotated and for this purpose there is provided a piston 70 illustrated in FIG. 2 which rotates the propeller forwardly once it has been disengaged from the bowl. This permits cleaning of the propeller blades. The up and down operation is facilitated by means of guides 72 and associated slide bearings 74. As illustrated in FIG. 3, the entire framework for supporting the mixer is supported from the top of the rugged chamber 36. The construction also includes a pair of hinges 79 that also permit sideway pivoting of the mixer 34.

FIG. 3 also shows, within the chamber 36 a lazy-Susan 80 interconnected by a bearing 81 to the lazy-Susan circular handle 38. FIG. 3 also illustrates legs 84 that support the chamber 36. The handle 38 is adapted to be easily rotated to in turn cause direct rotation of the lazy-Susan 80. FIG. 3 illustrates a series of flasks 85 supported about the periphery of the lazy-Susan with one of these flasks being in a position directly under a spout 86 which is supported within the chamber 36 below a control ball valve 87. The previously mixed material in the bowl 20 under the control of the valve 87 is caused to exit from the spout 86 under manual control to each one of the flasks 85. After each one of the flasks is filled then the lazy-Susan is moved so that the next one is in position under the spout 86 for filling. This is accomplished by the operator viewing through the view port 52 at the front door of the chamber 36. To assist in the viewing there is also provided an explosion proof light 88 or series of lights that provide sufficient illumination within the chamber 36. In connection with the ball valve control it is noted that FIG. 3 also illustrates a ball valve control handle 90, further details of which are illustrated hereinafter in FIG. 4.

Now, in FIG. 4 there is shown bowl 20 with its associated cover 62. Between the bowl and cover there are provided a series of annular seals 92 also illustrated in FIG. 5. Rinse lines 60 are shown coupling to the cover 62 and through the cover to two different series of nozzles including a side aimed rinse nozzle 93 and a downward aimed rinse nozzle 94. FIG. 5 clearly illustrates the disposition of these different side aimed and downward aimed rinse nozzles. In FIG. 4 there is shown the powder input line 46 and the powder output line 49 both associated with the mixing bowl 20. Also shown in FIG. 4 is the water and LUDOX (investment casting strengthener) input tube 28. FIG. 4 also shows further details of the ball valve 87 and the associated pouring spout 86. It is noted that the ball valve 87 is intermediate bottom exit port 96 from the bowl 20 and the spout 86. Also shown in FIG. 4 is the propeller 65 with its associated propeller shaft 95. The handle 90 connects to an operating rod 91 for operating the ball valve 87 in a conventional manner. The bowl 20 is secured to the top wall of the chamber 36 by means of bolts and associated gaskets as illustrated in FIG. 4.

Figure 6:
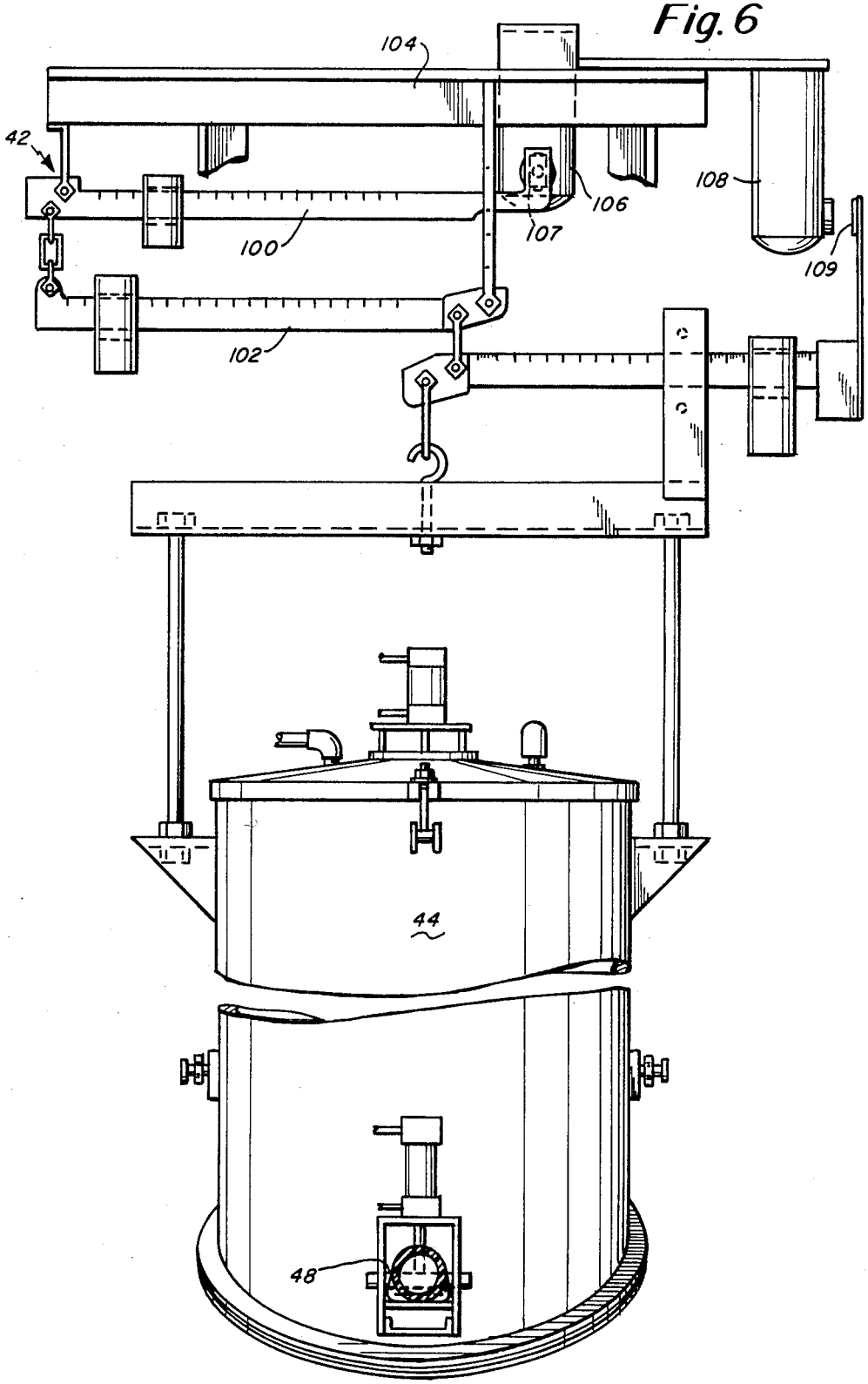
FIG. 6 is a cross-sectional view taken along line 6—6 of FIG. 1 showing further details for the powder weighing technique.

FIG. 6 shows further details of the weighing chamber 44 and the associated scale apparatus 42. The scale apparatus is actually a double scale including a first scale 100 which is a rough adjustment scale. In accordance with the double scale concept that is employed one scale is for zero weight adjustment for the entire unit and the other scale is for the weight of the powder. It is a scale 102 that is for powder weight and is considered as a fine adjustment scale. At the top of FIG. 6 there is shown a support member 104 having associated therewith a first electric eye 106 and associated mirror 107 and a second electric eye 108 and associated reflective mirror 109. These electric eyes operate to control the air pressure to blow air and powder into the mixing bowl. Reference may also be made to FIG. 1 in connection with this portion of the operation. In FIG. 1 it is noted that there is provided the valve 511 which is used to maintain a vacuum. The pinch valve 48 closes when the weight decreases to indicate that the weighing chamber 44 is about empty. There is also provided another pinch valve 110 which is operated to stop flow from the hopper 40 when the weigh chamber 44 is up to weight. It is also noted in FIG. 1 that there is an input air line 112 to the lower section 114 of the hopper and also an air input line 116 to the weigh chamber 44. Air pressure blows the powder from the hopper into the intermediate weighing chamber 44 by way of this pinch valve 110. Again, however, the pinch valve 110 operates to stop this flow from the upper hopper when the weighing chamber indicates that it is to the desired weight.

Figure 7:
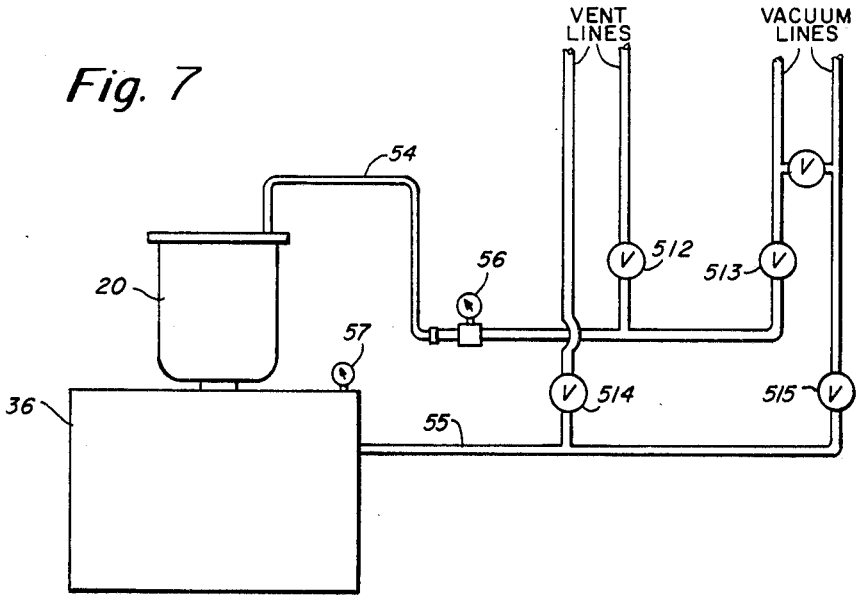
FIG. 7 is a schematic diagram showing the connection of vacuum lines with respect to both the mixing bowl and associated chamber.

In view of the number of different lines and components illustrated in FIG. 1, it is believed that an understanding of the vacuum portion of the system will be better understood with reference to FIG. 7. FIG. 7 shows the vacuum lines coupling to both the mixing bowl 20 and the chamber 36. The bowl and chamber are shown schematically in FIG. 7. FIG. 7 also illustrates the vent lines which couple off of the vacuum lines and which are instrumental in releasing the vacuum that is drawn on the mixing bowl and the chamber. Valves 513 and 515 control the application of vacuum to the respective bowl and chamber. Valves 512 and 514 control the venting of the vacuum to the shown vent lines.

To now summarize the operation, the LUDOX (investment casting strengthener) in the chamber 10 is first permitted to pass to the valve 601. Soon thereafter, the water is introduced to the line 29 and the water is used to flush both the water and LUDOX (investment casting strengthener) into the mixing bowl 20. This sequence of operation is such that the valve 602 operates first followed by the valve 601 so as to provide the proper flushing action, particularly of the LUDOX (investment casting strengthener) and to cause some mixing of the LUDOX (investment casting strengthener) with the water even prior to introduction into the mixing bowl 20.

After the LUDOX (investment casting strengthener) and water are delivered to the mixing bowl, then the powder is blown into the mixing bowl. In this connection it is noted that the powder is delivered from the powder hopper 40 to the weighing chamber 44 so that when the powder is introduced into the mixng bowl, it is in a proper weighed amount. Any excess powder that may blow out of the mixing bowl goes by way of the return line 49 back into the powder hopper. In this way the powder is introduced to the mixing bowl without being impeded with any excess powder being returned by way of the return line to the powder hopper. In accordance with the invention vacuum is used in association with both the chamber in which the mixing occurs and the mixing bowl itself. As mentioned previously, the application of vacuum assures that no dimples appear on the final product. Once again, reference is made to FIG. 7 which shows basically the mixing bowl and chamber in schematic form but showing also separately all of the vacuum lines and associated vent lines.

Now, with respect to the mixing which occurs in the mixing bowl, it is noted that the mixing bowl is set up so that a vacuum can be drawn on it. However, initially, mixing occurs for a predetermined period of time without any vacuum until a timer which is part of the computer controls, times out. This mixing period may occur anywhere from one minute to three minutes. Thereafter, in accordance with the control of this invention, vacuum is drawn for on the order of a minute and a half so as to make sure that there are no air voids in the mixture. The continued mixing with vacuum may occur over a period in the range of one and one-half to three minutes. At the same time the vacuum is also drawn on the chamber to make sure that no air interferes with the mixed material which is poured in the chamber into metal stainless steel flasks in the form of molds. These flasks 85 illustrated in FIG. 3 are disposed on a lazy Susan 80 and the dispensing into each of these flasks is under manual control as shown by the valve control handle 90 illustrated in FIGS. 3 and 4. After the mixing has been completed and the manual control has delivered the material to the flasks, then the vacuum is released. In this connection the valves 512 and 514 operate so as to vent the vacuum that has been drawn on the chamber 36 and the mixing bowl 20. The flasks may then be removed from the chamber and allowed to set up. In accordance with the invention there is also provided for cleaning of the mixing bowl and in this connection it is noted, as illustrated in FIGS. 4 and 5 that there are provided rinse nozzles 93 and 94 which are operated for a predetermined period of time to rinse out the mixing bowl in readiness for the next mixing batch. Once the mixing bowl is cleaned by rinsing, then the manual valve may be operated to remove all of this material into some type of a container disposed in the chamber which can then be removed fom the chamber.

Having now described one process and associated apparatus of this invention, it should now be apparent to those skilled in the art that numerous other embodiments are contemplated as falling within the scope of this invention.

What is claimed is:

1. Casting apparatus for providing mixing of water, casting powder and an additive, to be delivered to molds after mixing to form casting molds, comprising;

means defining a source of water, means defining a source of an additive, means defining a source of investment powder, a mixing bowl, first control means including means for coupling the water and additive to the mixing bowl, means for thereafter delivering the casting powder to the mixing bowl and means for controlling vacuum drawn on the mixing bowl, means associated with the mixing bowl for mixing the water, additive and casting powder, said mixing bowl having an outlet spout means including valve means, a pouring chamber under said mixing bowl, second control means, separate and independent of said means for controlling vacuum drawn on the mixing bowl, for controlling vacuum drawn on the pouring chamber, said first control means including means for providing mixing for a first predetermined time absent vacuum control and thereafter providing mixing under vacuum for a second predetermined time, said valve means being operated after mixing is completed to enable portions of the mixed material to be dispensed into molds in the chamber, said first control means and said second control means adapted to draw vacuum during said second predetermined time separately and directly on said mixing bowl and pouring chamber, respectively.

2. Casting apparatus as set forth in claim 1 wherein said additive is a strengthener.

3. Casting apparatus as set forth in claim 1 wherein said source of water includes a water tank, weight and associated weight position control relative to the tank.

4. Casting apparatus as set forth in claim 1 wherein said source of powder includes a powder hopper coupling to a powder weighing chamber that is adapted to deliver a pre-weighed amount of powder to the mixing bowl.

5. Casting apparatus as set forth in claim 1 wherein said source of powder includes a closed loop system having a powder coupling line and a powder return line coupling from the mixing bowl back to the source of powder.

6. Casting apparatus as set forth in claim 1 wherein said valve means comprises a manually operated valve operated from outside the chamber.

7. Casting apparatus as set forth in claim 1 including means operated from outside the chamber to rotate molds therein.

8. Casting apparatus as set forth in claim 1 wherein said outlet spout means is stationary and is disposed off-center of the pouring chamber toward the periphery thereof.

9. Casting apparatus as set forth in claim 8 in combination with means operated outside of the pouring chamber to selectively rotate molds therein into alignment with the outlet spout means.

10. Casting apparatus as set forth in claim 1 wherein vacuum is also drawn on the pouring chamber substantially concurrently with being drawn on the mixing bowl.

11. Casting apparatus as set forth in claim 10 wherein the mixing without vacuum is in the range of one to three minutes.

12. Casting apparatus as set forth in claim 10 wherein the mixing with vacuum is in the range of one and one half to three minutes.

13. Casting apparatus as set forth in claim 1 including a source of vacuum and a first vacuum line coupling from the source of vacuum to the mixing bowl and a second vacuum line coupling from the source of vacuum to the pouring chamber.

14. Casting apparatus as set forth in claim 13 wherein said means for controlling vacuum drawn on the mixing bowl comprises a control valve in said first vacuum line.

15. Casting apparatus as set forth in claim 14 wherein said means for controlling vacuum drawn on the pouring chamber comprises a control valve in said second vacuum line.

16. Casting apparatus as set forth in claim 15 wherein said first vacuum line couples only to said mixing bowl and said second vacuum line couples only to said pouring chamber.

17. Casting apparatus as set forth in claim 1 wherein said outlet spout means is stationary and disposed off-center of the pouring chamber toward the periphery thereof and directly under said valve means, said pouring chamber having a viewing port through which one can observe mold position relative to the spout means to readily control alignment therebetween, and means operated from outside and under the chamber to selectively rotate molds therein into alignment with the outlet spout means.

18. Casting apparatus as set forth in claim 17 wherein said outlet spout means is disposed at the periphery of the pouring chamber but adjacent said viewing port.

19. Casting apparatus as set forth in claim 18 wherein said pouring chamber has a door with the viewing port therein.

20. Casting apparatus as set forth in claim 1 wherein said means defining a source of investment powder comprises a powder hopper, a powder weighing chamber and means intercoupling the powder hopper and powder weighing chamber.

21. Casting apparatus as set forth in claim 20 wherein said means for delivering the powder to the mixing bowl includes blowing means associated with at least the powder weighing chamber for blowing the powder weighed therein into the mixing bowl.

22. Casting apparatus as set forth in claim 21 including, first valve means between the powder hopper and powder weighing chamber and second valve means between the powder weighing chamber and mixing bowl.

23. Casting apparatus as set forth in claim 22 wherein the first valve means enables powder delivery from the powder hopper to the powder weighing chamber, and the second valve means enables weighed powder delivery from the powder weighing chamber to the mixing bowl.

24. Casting apparatus as set forth in claim 23 including a powder return line from the mixing bowl back to the powder hopper to retrieve powder from the mixing bowl.

25. Casting apparatus as set forth in claim 1 including a water line coupling from the source of water, an additive line coupling from the source of the additive and a common line leading in communication from said water and additive lines.

26. Casting apparatus as set forth in claim 25 including a first valve in said water line and a second valve in said common line.

27. Casting apparatus as set forth in claim 26 including means for opening said first valve before said second valve to permit pre-mixing of the water and additive before the second valve is opened.

28. Foundry casting process for providing mixing of a casting powder with a liquid in a mixing bowl to form casting molds, said process comprising the steps of; providing a source of the powder, providing a source of the liquid, providing a vacuum source, coupling the source of the liquid to the mixing bowl, providing a powder hopper, weighing a predetermined amount of powder from the powder hopper, blowing the predetermined amount of powder into the mixing bowl, mixing the powder and liquid first without vacuum at substantially normal atmospheric pressure for a first predetermined period of time, thereafter mixing the powder and liquid under vacuum for a second predetermined period of time, to remove substantially all air voids and then selectively and under manual control delivering the mixture to molds.

29. Foundry casting process as set forth in claim 28 wherein said liquid includes water and an additive with a further step of at least partially pre-mixing the water and additive.

30. Foundry casting process as set forth in claim 28 wherein the mixing without vacuum is in the range of one to three minutes.

31. Foundry casting process as set forth in claim 28 wherein the mixing with vacuum is in the range of one and one half to three minutes.

32. Foundry casting process as set forth in claim 28 wherein the step of delivery to the molds occurs in a chamber having a vacuum drawn thereof during delivery.

33. Casting apparatus for providing mixing of at least water and a casting powder to be delivered to molds after mixing to form casting molds, comprising;

means defining a source of water, means defining a source of investment powder, a mixing bowl, automatic control means including means for coupling the water to the mixing bowl, means for thereafter delivering the investment powder to the mixing bowl and means for controlling vacuum drawn on the mixing bowl, means associated with the mixing bowl for mixing the water and investment powder, said mixing bowl having an outlet spout means including valve means, a pouring chamber under said mixing bowl, said valve means being operated after mixing is completed to enable portions of the mix material to be dispensed into molds in the pouring chamber, said outlet spout means being stationary and disposed off-center of the pouring chamber toward the periphery thereof and directly under said valve means, and means operated from outside and under the pouring chamber to selectively rotate molds therein into alignment with the outlet spout means, said pouring chamber having a viewing port through which one can observe mold position relative to the spout means to readily control alignment therebetween.

34. Casting apparatus as set forth in claim 33 wherein said outlet spout means is disposed at the periphery of the pouring chamber but adjacent said viewing port.

35. Casting apparatus as set forth in claim 33 wherein said pouring chamber has a door with the viewing port therein.

* * * * *